US012789324B2

(12) United States Patent
Ramanath et al.

(10) Patent No.: US 12,789,324 B2
(45) Date of Patent: Nov. 10, 2026

(54) COMPOSITE CLUSTER STRUCTURED ABRASIVE

(71) Applicant: Molecular Bond Superabrasives, LLC, Columbia, SC (US)

(72) Inventors: Srinivasan Ramanath, Columbia, SC (US); Joseph E. Smith, Columbia, SC (US); Samuel Lyman Munson, IV, Columbia, SC (US)

(73) Assignee: Molecular Bond Superabrasives, LLC, Columbia, SC (US)

( * ) Notice: Subject to any disclaimer, the term of this patent is extended or adjusted under 35 U.S.C. 154(b) by 666 days.

(21) Appl. No.: 18/121,999

(22) Filed: Mar. 15, 2023

(65) Prior Publication Data

US 2023/0294243 A1 Sep. 21, 2023

Related U.S. Application Data

(60) Provisional application No. 63/319,804, filed on Mar. 15, 2022.

(51) Int. Cl.
*B24D 3/34* (2006.01)
*B24D 18/00* (2006.01)

(52) U.S. Cl.
CPC ..... *B24D 3/346* (2013.01); *B24D 18/0054* (2013.01)

(58) Field of Classification Search
CPC .... B24D 18/005; B24D 3/346; C09K 3/1436; C09K 3/1445
See application file for complete search history.

(56) References Cited

U.S. PATENT DOCUMENTS

| | | | | |
|---|---|---|---|---|
| 4,606,738 A * | 8/1986 | Hayden | F01D 5/22 | 51/307 |
| 4,954,140 A * | 9/1990 | Kawashima | C09K 3/1436 | 51/296 |
| 5,672,382 A * | 9/1997 | Lux | C04B 35/62897 | 51/293 |
| 2005/0118237 A1* | 6/2005 | Krzysik | A61K 8/0208 | 424/443 |
| 2005/0118939 A1* | 6/2005 | Duescher | B24D 11/001 | 451/527 |
| 2010/0159806 A1* | 6/2010 | Wu | C09K 3/1418 | 451/28 |

* cited by examiner

*Primary Examiner* — Pegah Parvini
(74) *Attorney, Agent, or Firm* — Todd A. Serbin; Maynard Nexsen PC

(57) ABSTRACT

An abrasive structure for abrading work pieces, comprising: a composite cluster formed of abrasives of two or more sizes, wherein a larger size abrasive forms a core of the abrasive structure with a smaller size abrasive attached on an exterior of the core.

19 Claims, 4 Drawing Sheets

COMPOSITE CLUSTER STRUCTURED ABRASIVE

RELATED APPLICATION

This application claims the benefit of priority under 35 U.S.C. § 119(e) of U.S. Provisional Patent Application No. 63/319,804, filed Mar. 15, 2022, the contents of which are incorporated herein by reference in their entirety.

FIELD AND BACKGROUND OF THE INVENTION

The present invention, in some embodiments thereof, relates to industrial abrasives and, more particularly, but not exclusively, to the structure of an abrasive material.

SUMMARY OF THE INVENTION

According to an aspect of some embodiments of the present invention there is provided an abrasive structure for abrading work pieces, comprising: a composite cluster formed of abrasives of two or more sizes, wherein a larger size abrasive forms a core of the abrasive structure with a smaller size abrasive attached on an exterior of the core.

In an embodiment of the invention, the composite cluster is attached to a substrate.

In an embodiment of the invention, the composite cluster is attached to a substrate in a mono layer or as multiple layers.

In an embodiment of the invention, wherein the substrate is steel or carbide.

In an embodiment of the invention, the abrasive structure is applied to a grinding wheel or a honing stick.

In an embodiment of the invention, the ratio of an average nominal size of the larger size abrasive to that of an average nominal size of the smaller abrasive ranges between 2 and 300.

In an embodiment of the invention, the ratio is between 2 and 30.

In an embodiment of the invention, the ratio is between 2 and 10.

In an embodiment of the invention, the ratio of smaller size abrasive to larger size abrasive ranges between 0.01% to 35% by volume.

In an embodiment of the invention, the abrasives are selected from at least one of diamond, cubic boron nitride, aluminum oxide, silicon carbide, boron carbide, tungsten carbide, zirconium oxide, a metal alloy, hollow microspheres of metals, hollow microspheres of ceramics, or a combination of two or more thereof.

In an embodiment of the invention, the abrasive structure further comprises materials not primarily used as abrasives, such as metals, alloys, glass or resin.

In an embodiment of the invention, the materials not primarily used as abrasives exhibit a porosity up to 50%.

In an embodiment of the invention, the smaller abrasive is attached to the larger sized abrasive by chemical bonding for increased strength.

In an embodiment of the invention, the chemical bonding is through transitional elements such as titanium, chromium or vanadium that form an intermetallic compound.

In an embodiment of the invention, the abrasive structure further comprises abrasives in the abrasive structure but not in the composite cluster selected from at least one of diamond, cubic boron nitride, aluminum oxide, silicon carbide, zirconium oxide, alumina-zirconia or boron carbide.

In an embodiment of the invention, the chemical bonding is through transitional elements such as titanium, chromium or vanadium that form an intermetallic compound.

In an embodiment of the invention, a braze content is 10% to 50% by volume in the cluster composite when being made as a separate article.

In an embodiment of the invention, a braze content is 25% to 75% by volume in the cluster composite when being made in-situ.

According to an aspect of some embodiments of the present invention there is provided a method of making an abrasive structure, comprising: mixing larger sized abrasive and smaller sized abrasive with a braze alloy and an organic binder to form granules; sintering the granules in a furnace; using such sintered granules in place of grits to manufacture a grinding wheel.

In an embodiment of the invention, the organic binder is between 5% and 30% by volume of the granules prior to sintering.

According to an aspect of some embodiments of the present invention there is provided a method of making an abrasive structure in-situ, comprising: applying a braze powder with organic binder on wheel core, sprinkling large sized abrasive, applying more braze/organic binder and sprinkling smaller sized abrasive onto the larger sized abrasives; and sintering them in a furnace where the composite clusters are formed in-situ.

In an embodiment of the invention, the organic binder is between 5% and 30% by volume of the granules prior to sintering.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

BRIEF DESCRIPTION OF THE DRAWING

Some embodiments of the invention are herein described, by way of example only, with reference to the accompanying image. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

The present invention, in some embodiments thereof, relates to industrial abrasives and, more particularly, but not exclusively, to the structure of an abrasive material.

Before explaining at least one embodiment of the invention in detail, it is to be understood that the invention is not necessarily limited in its application to the details of construction and the arrangement of the components and/or methods set forth in the following description and/or illustrated in the image. The invention is capable of other embodiments or of being practiced or carried out in various ways.

Briefly, the cluster composites such as shown and described herein are applied to abrasive structures such as grinding wheels and/or honing sticks, in some embodiments of the invention. Such abrasive structures are used to mechanically abrade materials to a known and/or desired geometry and/or finish. Such clusters are optionally present as mono layers and/or multilayers that are attached to a substrate such as steel or carbide, in some embodiments of the invention.

Figure 1:
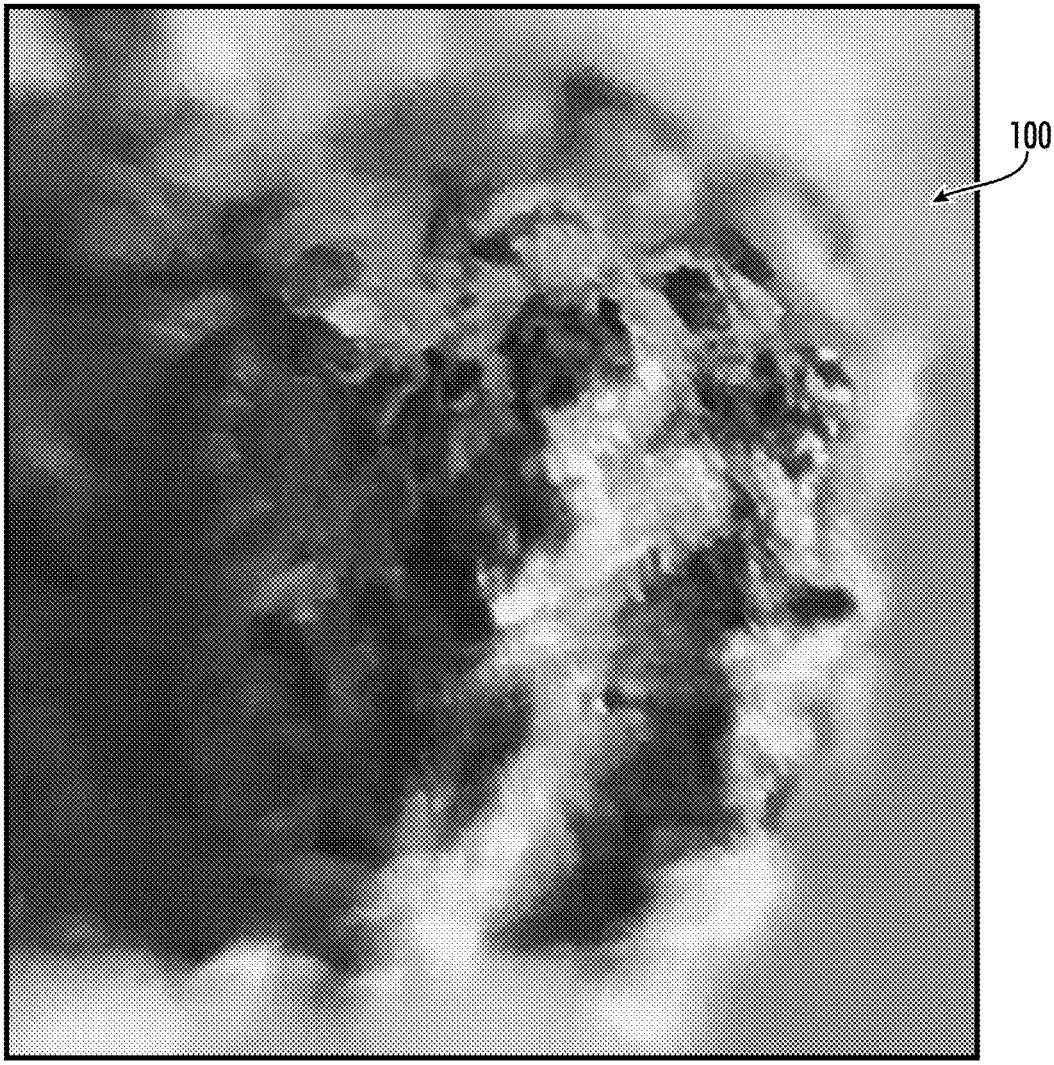
FIG. 1 is an image of a composite cluster structured abrasive, in accordance with an embodiment of the invention.

Referring now to the drawings, FIG. 1 is an image of a composite cluster abrasive 100, in accordance with an embodiment of the invention. In an embodiment, the abrasive structure comprises "composite clusters" of abrasives of two or more size distributions held together, in some embodiments optionally, using a chemical bond such as described herein, and optionally other materials such as described in more detail below. FIG. 1 shows one large diamond abrasive encapsulated by many small diamonds with braze holding them together. The large diamond is not visible in the image.

Unlike a mechanical bond, a chemical bond is stronger and leads to more open structure for aggressive material removal. Having smaller abrasives on top of larger ones provides a cutting action that provides better surface finish of the work material while maintaining durability of the abrasive structure. Such clusters are made in-situ, for example being used in place of abrasive grit on a grinding wheel, or separately, as an independent article, using metal bonds containing an active metal such as titanium or chromium, in some embodiments of the invention. The abrasives are substituted with compatible metal or alloys to provide unique benefits, in some embodiments of the invention.

Figure 2A:
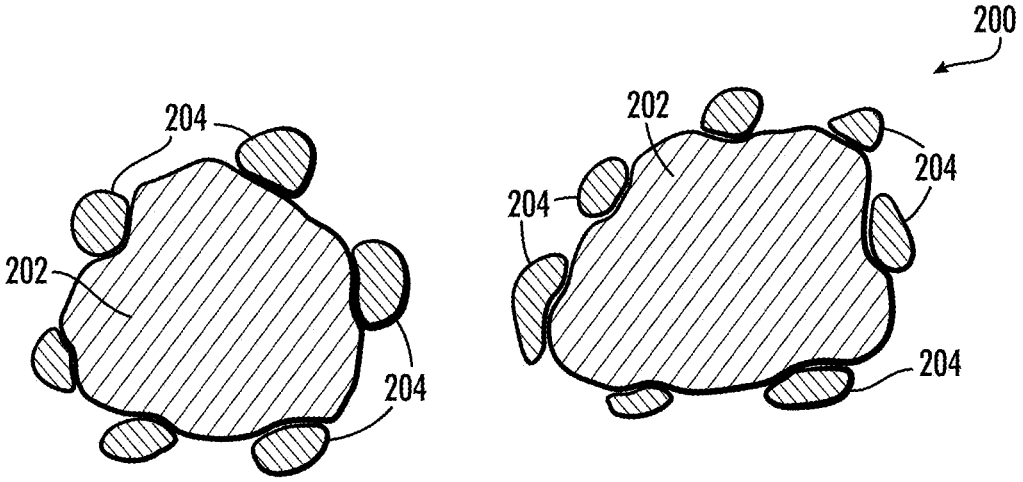
FIG. 2A is a drawing of a composite cluster structured abrasive formed separately, in accordance with an embodiment of the invention.
Figure 2B:
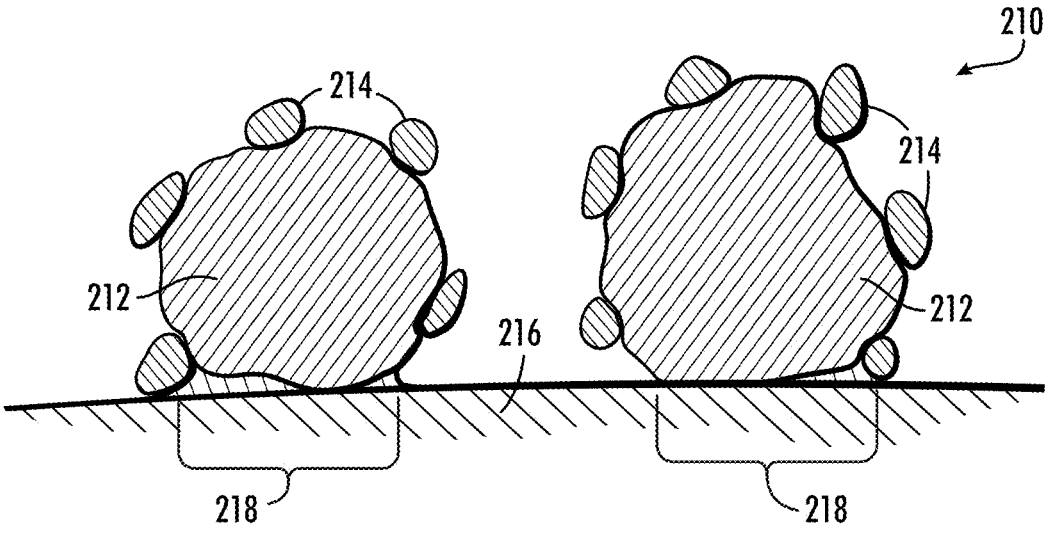
FIG. 2B is a drawing of a composite cluster structured abrasive formed in-situ, in accordance with an embodiment of the invention.
Figure 3:
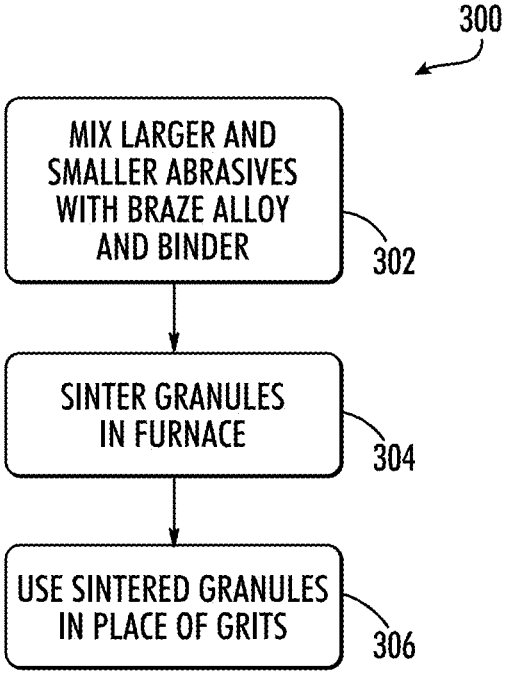
FIG. 3 is a flowchart of making a composite cluster structured abrasive separately, in accordance with an exemplary embodiment of the invention; and, FIG. 4 is a flowchart of making a composite cluster structured abrasive in-situ, in accordance with an exemplary embodiment of the invention.
Figure 4:
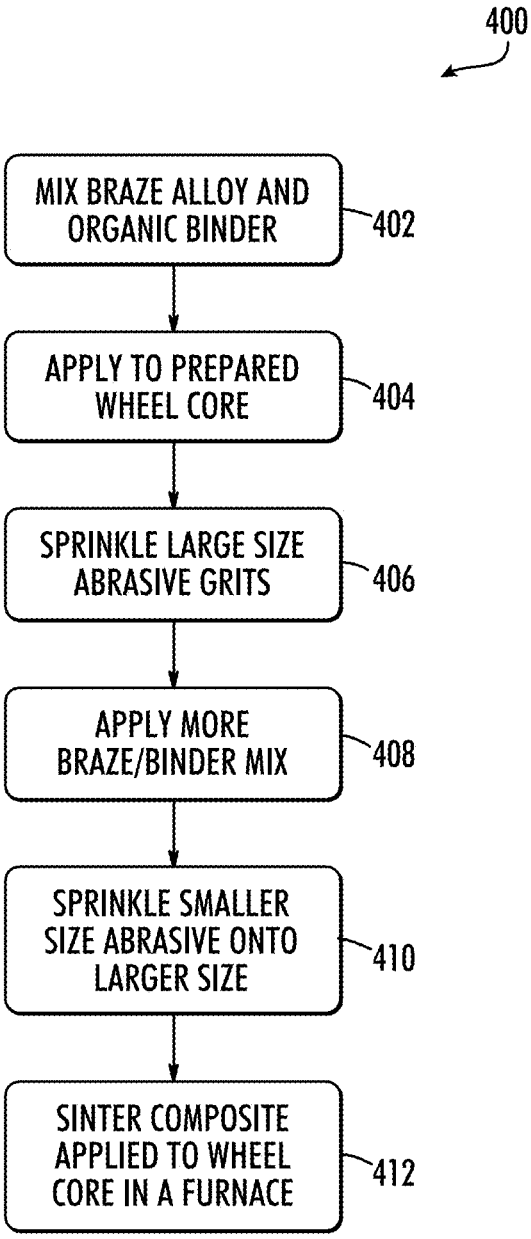

Similar in appearance to a COVID-19 virus particle (a SARS-CoV-2 S protein), the clusters 100, 200, 210 consist of small abrasives 204, 214 that are bonded chemically (as opposed to mechanical bonding) to larger abrasives 202, 212 to form a cluster, wherein the larger abrasives 202, 212 (singly or multiply) form a core of the abrasive structure, with the smaller abrasives 204, 214 attaching on the exterior of this core to form the overall composite 200, 210 shape, in some embodiments of the invention. In addition to having at least two differently sized abrasive components, a braze (braze alloy) is used which melts and holds them together, in an embodiment of the invention. Typically, the composite cluster by itself will have a high content of abrasive in proportion to the amount of braze. This will ensure that there is adequate exposure of the grit for efficient grinding action. In an embodiment of the invention, it also desirable to not bury the smaller abrasive in the cluster composite with the braze. In some embodiments of the invention, the braze content is 10% to 50% by volume in the cluster composite when being made as a separate article (such as shown in FIGS. 2A and 3). In embodiments where the composite cluster is made in-situ (such as shown in FIGS. 2B and 4), the braze content is typically higher, since a big amount is holding the large abrasive as well, approximately representing 25% to 75% by volume of the composite cluster.

A binder, for example an organic binder, is used to hold all the components together, but which typically burns off at low temperatures so would not likely be present in a finish product abrasive structure after the abrasive structure manufacturing process has been concluded. In some embodiments of the invention, the amount of organic binder selected is adequate to hold all the components together while in the "green state", which is between 5% and 30% by volume.

The cluster composites consist of abrasives of at least two nominal sizes, in some embodiments of the invention. The larger abrasive 202, 212 could vary from 1500 microns down to 50 microns in size (e.g. diameter). A smaller abrasive 204, 214 could vary from 750 microns down to 50 microns in size. Optionally, the smaller abrasive is as small as 5 microns. In FIG. 1, the size of the larger abrasive would be around 1250 microns and the smaller ones around 125 microns. The ratio of the average nominal size of the large abrasives to that of average nominal size of the small abrasives could range between 2 and 300, more typically 2 and 30 and even more typically 2 and 10, according to some embodiments of the invention. The ratio of smaller to larger abrasives ranges from 0.01 to 35% by volume, in some embodiments of the invention. The cluster composites have three or more nominal abrasive sizes, in some embodiments of the invention. It should be understood that sizes are given by way of example only, and that the sizes could be larger or smaller depending on the intended abrasive performance for the composite cluster.

The abrasives in the cluster composite are selected from at least one of diamond, cubic boron nitride, aluminum oxide, silicon carbide, boron carbide, tungsten carbide, and/or zirconium oxide or combinations thereof. The abrasives could also be replaced by metal alloys, hollow microspheres of metals or ceramics such as alumina or glass.

The abrasive structure could include materials other than the composite clusters, such as metals, alloys, glass or resin which are not used primarily as abrasives, but serve another purpose, for example to boost structural integrity of the abrasive structure. The structure of these materials exhibits a porosity up to 50%, in some embodiments of the invention.

The smaller abrasives of the cluster composite are chemically bonded to the larger ones for increased strength, in an embodiment of the invention. In an embodiment of the invention, the chemical bonding is through transitional elements such as titanium, chromium or vanadium that form an intermetallic compound.

In addition to the abrasives in the cluster composite, there are optionally more abrasives in the abrasive structure, in some embodiments of the invention. The type of abrasives would include diamond, cubic boron nitride, aluminum oxide, silicon carbide, zirconium oxide, alumina-zirconia or boron carbide.

The cluster composites are made separately and/or in-situ. If made separately, such as shown in the flowchart 300 of FIG. 3, larger sized abrasive and smaller sized abrasive would be mixed (302) with a braze alloy and an organic binder to form granules, which are then sintered (304) in a furnace, in an embodiment of the invention. Such clusters are then mixed with more bond to manufacture an abrasive structure, in an embodiment of the invention. In some embodiments, when composite clusters are made separately, they are then subsequently used (306) for attachment in a monolayer or multilayer to a grinding wheel core (or honing stick) through a braze. In some embodiments of the invention, there are no small diamonds in the braze. This is in contrast to in-situ manufacturing, as described in more detail below.

The in-situ method is shown in the flowchart 400 of FIG. 4. In an embodiment of the invention, the method commences with mixing (402) a braze alloy powder and an organic binder, which is then applied (404) to a prepared grinding wheel core 216. The grinding wheel core 216 functions as a substrate for the abrasive structure which will be subsequently applied to it. Larger size abrasive, optionally in the form of grits, is sprinkled (406) onto the braze alloy powder and the binder applied to the wheel core, in an embodiment of the invention. More braze and/or binder, optionally as a mixture, is applied (408) on top and then smaller sized abrasive, optionally in the form of grits, is sprinkled (410) onto the braze/binder/larger sized abrasive, in an embodiment of the invention. The resultant layering of braze/binder/abrasive and the wheel core are sintered (412) in a furnace to form composite clusters attached to the wheel core 216 (in some embodiments, smaller abrasive bonded to the larger abrasive, which is in turn bonded to the wheel core), in an embodiment of the invention. In some embodiments of the invention, an area 218 on the "bottom" of a composite cluster does not have smaller abrasive attached to it since the larger abrasive was previously adhered to the underlying substrate (e.g. wheel core 216) in that area 218.

In an embodiment of the invention, the braze used between the abrasives is the same braze used to chemically bond the composite clusters to the wheel core 216. In some embodiments of the invention, sprinkling (410) smaller abrasive on top of the large abrasive in-situ enables the deposit of some smaller abrasive in between the larger abrasive (in addition to being on top of the larger abrasive), further enhancing the abrading abilities of the formed abrasive structure and thusly, the grinding wheel core 216 to which it is applied.

It should also be understood that while the abrasive structures herein are described as being used with grinding wheels and honing sticks, they could be applied to any implement which requires or could benefit from having an abrasive surface.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An abrasive structure for abrading work pieces, comprising:

a composite cluster formed of abrasives of two or more sizes, wherein a larger size abrasive forms a core of the abrasive structure with a smaller size abrasive attached on an exterior of the core, wherein the smaller abrasive is attached to the larger sized abrasive by chemical bonding for increased strength, and wherein the chemical bonding is through transitional elements such as titanium, chromium or vanadium that form an intermetallic compound.

2. The abrasive structure according to claim 1, wherein the composite cluster is attached to a substrate.

3. The abrasive structure according to claim 2, wherein the composite cluster is attached to a substrate in a mono layer.

4. The abrasive structure according to claim 2, wherein the composite cluster is attached to a substrate in as multiple layers.

5. The abrasive structure according to claim 2, wherein the substrate is steel or carbide.

6. The abrasive structure according to claim 1, wherein the abrasive structure is applied to a grinding wheel or a honing stick.

7. The abrasive structure according to claim 1, wherein the ratio of an average nominal size of the larger size abrasive to that of an average nominal size of the smaller abrasive ranges between 2 and 300.

8. The abrasive structure according to claim 7, wherein the ratio is between 2 and 30.

9. The abrasive structure according to claim 7, wherein the ratio is between 2 and 10.

10. The abrasive structure according to claim 1, wherein the ratio of smaller size abrasive to larger size abrasive ranges between 0.01% to 35% by volume.

11. The abrasive structure according to claim 1, wherein the abrasives are selected from at least one of diamond, cubic boron nitride, aluminum oxide, silicon carbide, boron carbide, tungsten carbide, zirconium oxide, a metal alloy, hollow microspheres of metals, hollow microspheres of ceramics, or a combination of two or more thereof.

12. The abrasive structure according to claim 1 wherein the abrasive structure further comprises at least one material not primarily used as an abrasive selected from metals, alloys, glass and resin.

13. The abrasive structure according to claim 12, wherein the at least one material not primarily used as an abrasive exhibits a porosity up to 50%.

14. The abrasive structure according to claim 1, further comprising a braze, wherein a braze content is 10% to 50% by volume in the cluster composite when being made as a separate article.

15. The abrasive structure according to claim 1, further comprising a braze, wherein a braze content is 25% to 75% by volume in the cluster composite when being made in-situ.

16. The abrasive structure according to claim 1, further comprising abrasives in the abrasive structure but not in the composite cluster selected from at least one of diamond, cubic boron nitride, aluminum oxide, silicon carbide, zirconium oxide, alumina-zirconia or boron carbide.

17. An abrasive structure for abrading work pieces, comprising:

a composite cluster formed of abrasives of two or more sizes, wherein a larger size abrasive forms a core of the abrasive structure with a smaller size abrasive attached on an exterior of the core, and a braze, wherein the braze content is 10% to 50% by volume in the composite cluster when being made as a separate article.

18. An abrasive structure for abrading work pieces, comprising:

a composite cluster formed of abrasives of two or more sizes, wherein a larger size abrasive forms a core of the abrasive structure with a smaller size abrasive attached on an exterior of the core, and a braze, wherein the braze content is 25% to 75% by volume in the composite cluster when being made in-situ.

19. An abrasive structure for abrading work pieces, comprising:

a composite cluster formed of abrasives of two or more sizes, wherein a larger size abrasive forms a core of the abrasive structure with a smaller size abrasive attached on an exterior of the core; and, abrasives in the abrasive structure, but not in the composite cluster, selected from at least one of diamond, cubic boron nitride, aluminum oxide, silicon carbide, zirconium oxide, alumina-zirconia or boron carbide.

* * * * *